US010451093B2

(12) United States Patent
Kobayashi et al.

(10) Patent No.: US 10,451,093 B2
(45) Date of Patent: Oct. 22, 2019

(54) FLUID PRESSURE CYLINDER

(71) Applicant: KYB-YS CO., LTD., Nagano (JP)

(72) Inventors: Nobuyuki Kobayashi, Nagano (JP); Tatsuya Hirai, Nagano (JP); Shinji Satou, Nagano (JP)

(73) Assignee: KYB-YS CO., LTD., Nagano (JP)

( * ) Notice: Subject to any disclaimer, the term of this patent is extended or adjusted under 35 U.S.C. 154(b) by 27 days.

(21) Appl. No.: 15/765,075

(22) PCT Filed: Sep. 21, 2016

(86) PCT No.: PCT/JP2016/077848

§ 371 (c)(1),
(2) Date: Mar. 30, 2018

(87) PCT Pub. No.: WO2017/057132

PCT Pub. Date: Apr. 6, 2017

(65) Prior Publication Data

US 2018/0274565 A1 Sep. 27, 2018

(30) Foreign Application Priority Data

Oct. 1, 2015 (JP) ..... 2015-195786

(51) Int. Cl.

| | |
|---|---|
| ***F15B 15/22*** | (2006.01) |
| ***F15B 15/14*** | (2006.01) |
| *E02F 9/22* | (2006.01) |

(52) U.S. Cl.
CPC ..... *F15B 15/222* (2013.01); *F15B 15/1457* (2013.01); *E02F 9/2271* (2013.01)

(58) Field of Classification Search
CPC ..... F15B 15/222
See application file for complete search history.

(56) References Cited

U.S. PATENT DOCUMENTS 3,067,726 A * 12/1962 Williams ..... F15B 15/223 91/395
6,481,331 B1 * 11/2002 Guo ..... F15B 15/222 91/395

FOREIGN PATENT DOCUMENTS

| | | |
|---|---|---|
| JP | H06-40326 Y2 | 10/1994 |
| JP | H7-44805 Y2 | 10/1995 |
| JP | H11-82426 A | 3/1999 |

* cited by examiner

*Primary Examiner* — F Daniel Lopez
(74) *Attorney, Agent, or Firm* — Rabin & Berdo, P.C.

(57) ABSTRACT

A fluid pressure cylinder includes a cushion bearing provided movably on an outer periphery of the piston rod; a flange portion provided on the piston rod by facing the piston with the cushion bearing between them; and a collar provided movably in a radial direction on the outer periphery of the piston rod between the cushion bearing and the flange portion. End surfaces of the cushion bearing and the collar are inclined symmetrically to a center axis of the piston rod, and end surfaces of the flange portion and the collar are formed having plane shapes crossing the center axis.

8 Claims, 12 Drawing Sheets

FLUID PRESSURE CYLINDER

TECHNICAL FIELD

The present invention relates to a fluid pressure cylinder.

BACKGROUND ART

In general, a fluid pressure cylinder includes a cushion mechanism for decelerating a piston rod by generating a cushion pressure in the vicinity of a stroke end of a piston rod (JP6-40326Y2).

In a fluid pressure cylinder disclosed in JP6-40326Y2, the piston rod has a normal diameter portion and a small diameter portion formed having a diameter smaller than that of the normal diameter portion. The piston is connected to the piston rod so as to face a stepped portion between the normal diameter portion and the small diameter portions. On an outer periphery of the small diameter portion of the piston rod, a cylindrical cushion bearing is movably provided between the stepped portion and the piston rod. An inner diameter of the cushion bearing is larger than an outer diameter of the small diameter portion, and a gap (inner peripheral gap) is formed between the cushion bearing and the small diameter portion.

Moreover, in the fluid pressure cylinder disclosed in JP6-40326Y2, a cylinder head has a bore formed capable of entry of the cushion bearing. In an expanding operation of the fluid pressure cylinder, the cushion bearing enters the bore of the cylinder head in front of a most expanded position. At this time, the cushion bearing is pressed onto a step of the piston rod by a pressure inside a rod side chamber, and flowing of an operating fluid from the rod side chamber to a port is limited only through a gap (outer peripheral gap) between the cushion bearing and the bore. Resistance is applied to a flow of the operating fluid moving from the rod side chamber to the port through the outer peripheral gap, and the piston is decelerated.

SUMMARY OF INVENTION

The cushion bearing disclosed in JP6-40326Y2 has a gap between it and the piston rod and thus, it is inclined with respect to the piston rod and moves in a radial direction with respect to the piston rod. The inclination or movement of the cushion bearing can occur even after the cushion bearing has entered the bore of the cylinder head, and an unintended gap (passage) is formed between the stepped portion and the cushion bearing in some cases.

If the unintended passage is formed in the vicinity of the stroke end of the piston rod, the operating fluid in the rod side chamber not only moves to the port through the outer peripheral gap but also moves to the port through the unintended passage, and desired resistance is not applied to the flow of the operating fluid. That is, the rod side chamber and the port communicate with each other through the unintended passage, whereby cushioning performances are lowered.

The present invention has an object to provide a fluid pressure cylinder which can prevent lowering of the cushioning performances.

According to one aspect of the present invention, a fluid pressure cylinder includes a cylinder tube; a piston slidably accommodated in the cylinder tube, the piston defining a rod side chamber in the cylinder tube; a piston rod connected to the piston; a port communicating with the rod side chamber, the port being configured to supply an operating fluid from an outside to the rod side chamber and discharge the operating fluid in the rod side chamber to the outside; a cushion bearing provided movably on an outer periphery of the piston rod, the cushion bearing being configured to narrow down the flow of the operating fluid discharged from the rod side chamber through the port when the piston rod reaches a stroke end; a limiting portion provided on the piston rod by facing the piston with the cushion bearing between them, the limiting portion being configured to limit movement of the cushion bearing in an axial direction; and a collar provided movably in a radial direction on the outer periphery of the piston rod between the cushion bearing and the limiting portion. End surfaces of the cushion bearing and the collar faced with each other are inclined symmetrically to a center axis of the piston rod, and end surfaces of the limiting portion and the collar faced with each other are formed having plane shapes crossing the center axis.

DESCRIPTION OF EMBODIMENTS

An embodiment of the present invention will be described below by referring to the attached drawings. Here, a hydraulic cylinder in which an operating oil is used as an operating fluid will be described, but other fluids such as an operating water may be used as the operating fluid.

First, a structure of the hydraulic cylinder 100 according to the embodiment of the present invention will be described. The hydraulic cylinder 100 is used as an actuator mounted on a machine such as a construction machine and an industrial machine. For example, the hydraulic cylinder 100 is used as an arm cylinder mounted on a hydraulic excavator.

Figure 1:
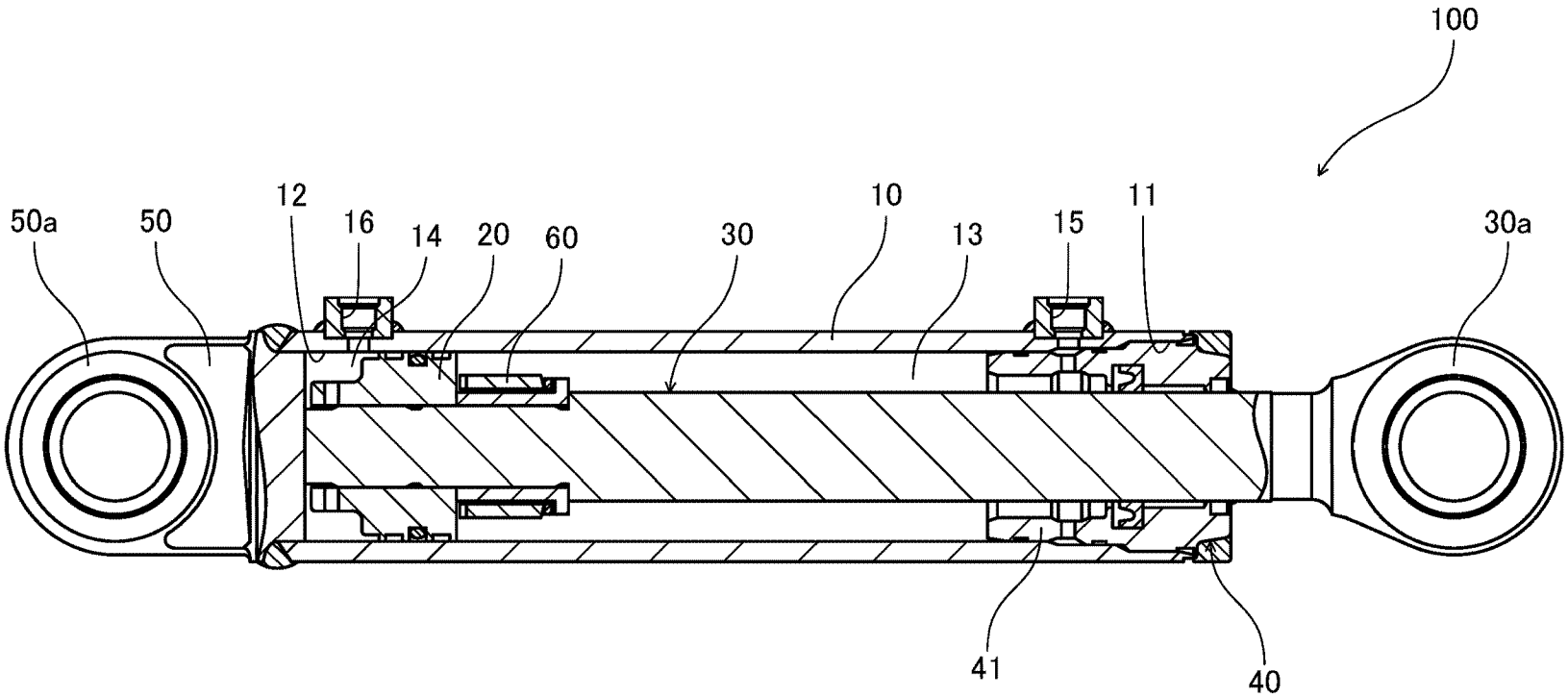
FIG. 1 is a partial sectional view of a hydraulic cylinder according to an embodiment of the present invention.

As illustrated in FIG. 1, the hydraulic cylinder 100 includes a cylindrical cylinder tube 10, a piston 20 slidably accommodated in the cylinder tube 10, and a piston rod 30 inserted into the cylinder tube 10, capable of advancing/retreating. One end of the piston rod 30 is connected to the piston 20, while the other end is extended to an outer side of the cylinder tube 10.

One opening end 11 of the cylinder tube 10 is closed by a cylinder head 40. The cylinder head 40 is formed annularly and slidably supports the piston rod 30. The other opening end 12 of the cylinder tube 10 is closed by a cylinder bottom 50.

The hydraulic cylinder 100 is mounted on a machine such as a construction machine and an industrial machine by using a connecting potion 30*a* provided on the other end of the piston rod 30 and a connecting portion 50*a* provided on the cylinder bottom 50.

The piston 20 divides an inside of the cylinder tube 10 into a rod side chamber 13 and an anti-rod side chamber 14. Specifically, the rod side chamber 13 is defined by the cylinder tube 10, the piston 20, and the cylinder head 40, and the anti-rod side chamber 14 is defined by the cylinder tube 10, the piston 20, and the cylinder bottom 50.

In the cylinder tube 10, a head-side port 15 communicating with the rod side chamber 13 and a bottom-side port 16 communicating with the anti-rod side chamber 14 are provided. In the following, the head-side port and the bottom-side port are referred to simply as "ports" in some cases.

The ports 15 and 16 are selectively connected to a hydraulic pump (not shown) or a tank (not shown) through a switching valve (not shown). When one of the ports 15 and 16 is made to communicate with the hydraulic pump by the switching valve, the other communicates with the tank.

When the operating oil from the hydraulic pump is supplied to the rod side chamber 13 through the port 15, the piston 20 and the piston rod 30 move to a direction for reducing the anti-rod side chamber 14, and the hydraulic cylinder 100 performs a contracting operation. At this time, the operating oil in the anti-rod side chamber 14 is discharged through the port 16.

When the operating oil from the hydraulic pump is supplied to the anti-rod side chamber 14 through the port 16, the piston 20 and the piston rod 30 move to a direction for reducing the rod side chamber 13, and the hydraulic cylinder 100 performs an expanding operation. At this time, the operating oil in the rod side chamber 13 is discharged through the port 15.

Moreover, the hydraulic cylinder 100 further includes an annular cushion bearing 60 provided on an outer periphery of the piston rod 30 and a cylindrical portion 41 provided on an inner periphery of the cylinder tube 10. The cylindrical portion 41 is formed integrally with the cylinder head 40 so that it can receive the cushion bearing 60.

In the expanding operation of the hydraulic cylinder 100, by means of entry of the cushion bearing 60 into the cylindrical portion 41 when the piston rod 30 reaches a stroke end, a flow of the operating oil discharged from the rod side chamber 13 through the port 15 is narrowed down. As a result, an expanding speed of the hydraulic cylinder 100 in the vicinity of the stroke end is decelerated.

Hereinafter, a structure around the cushion bearing 60 and narrowing-down of the flow of the operating oil by the cushion bearing 60 will be described in more detail by referring to FIGS. 2 to 12.

Figure 2:
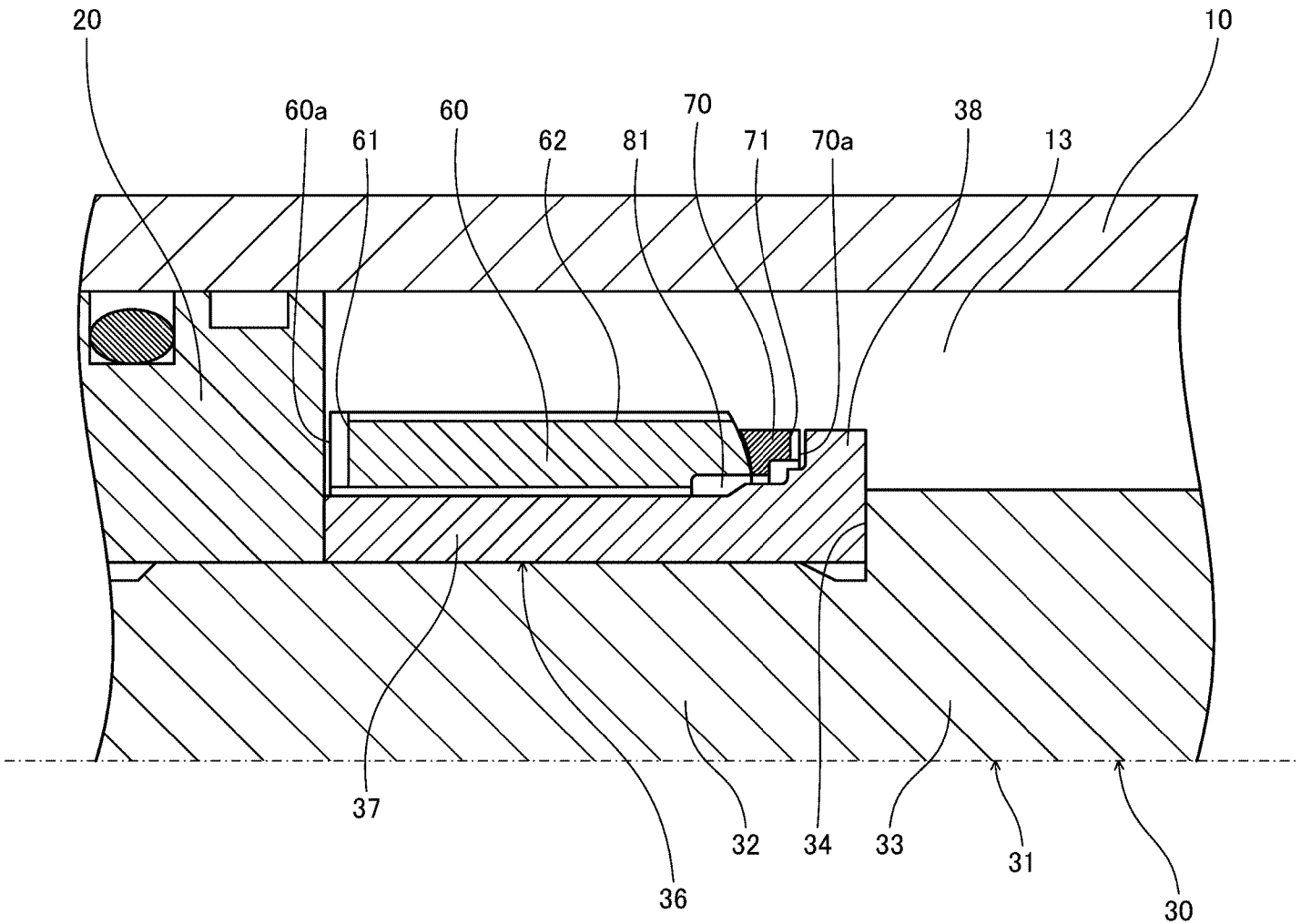
FIG. 2 is an enlarged sectional view around a cushion bearing and illustrates a state where a piston rod is in a normal stroke area.

First, the structure of the piston rod 30 will be described. As illustrated in FIG. 2, the piston rod 30 has a rod body 31 extending from the piston 20 to an outer side of the cylinder tube 10 and an annular spacer 36 into which the rod body 31 is inserted.

The rod body 31 has a small-diameter portion 32 having an outer diameter substantially equal to an inner diameter of the spacer 36 and a large-diameter portion 33 having an outer diameter larger than an outer diameter of the small-diameter portion 32. The large-diameter portion 33 is provided continuously to the small-diameter portion 32, and a rod stepped portion 34 is formed between the large-diameter portion 33 and the small-diameter portion 32. The small-diameter portion 32 has the spacer 36 inserted and is mounted on the piston 20 by screwing.

The spacer 36 has an annular spacer body 37 extending in an axial direction and a flange portion 38 annularly protruding from an end portion in the spacer body 37 on the rod stepped portion 34 side to an outer side in the radial direction. The spacer body 37 is sandwiched by the piston 20 and the rod stepped portion 34 by screwing the piston 20 with the small-diameter portion 32. That is, an interval between the piston 20 and the rod stepped portion 34 is ensured by the spacer body 37.

Subsequently, the structure of the cushion bearing 60 will be described.

The cushion bearing 60 is provided on an outer periphery of the spacer body 37. An inner diameter of the cushion bearing 60 is larger than an outer diameter of the spacer body 37. Therefore, the cushion bearing 60 is movable in the radial direction with respect to the spacer body 37.

An outer diameter of the cushion bearing 60 is larger than an outer diameter of the flange portion 38. That is, the flange portion 38 is faced with the piston 20 with the cushion bearing 60 between them and limits movement of the cushion bearing 60 in the axial direction. In the following, the flange portion 38 is also referred to as a "limiting portion" in some cases.

On an end surface 60*a* of the cushion bearing 60 faced with the piston 20, a groove (slit) 61 extending from an inner peripheral surface to an outer peripheral surface of the cushion bearing 60 is formed. On an outer peripheral surface of the cushion bearing 60, a groove (slit) 62 extending in the axial direction is formed.

Between the cushion bearing 60 and the flange portion 38, an annular collar 70 is provided. An inner diameter of the collar 70 is larger than the outer diameter of the spacer body 37, and the collar 70 is movable in the radial direction.

On an end surface 70*a* of the collar 70 faced with the flange portion 38, a groove (slit) 71 extending from an inner peripheral surface to an outer peripheral surface of the collar 70 is formed.

Since the inner diameters of the cushion bearing 60 and the collar 70 are larger than the outer diameter of the spacer body 37, an annular inner peripheral passage 81 is formed between the inner peripheral surfaces of the cushion bearing 60 and the collar 70 and the outer peripheral surface of the spacer body 37.

Moreover, a dimension of the cushion bearing 60 and the collar 70 combined in the axial direction is smaller than a dimension between the piston 20 and the flange portion 38.

Therefore, the cushion bearing 60 and the collar 70 are movable in the axial direction between the piston 20 and the flange portion 38.

In this embodiment, since the piston rod 30 has the spacer 36 and the spacer 36 has the flange portion 38, the spacer 36 pressed by the piston 20 and the flange portion 38 pressed by the collar 70 do not have to be formed by the same material as the rod body 31. Therefore, the rod body 31 can be formed by an inexpensive material with low strength, while the spacer 36 including the flange portion 38 can be formed by an expensive material with high strength, and the strength of the piston rod 30 can be improved while a cost increase of the piston rod 30 is suppressed.

Figure 3:
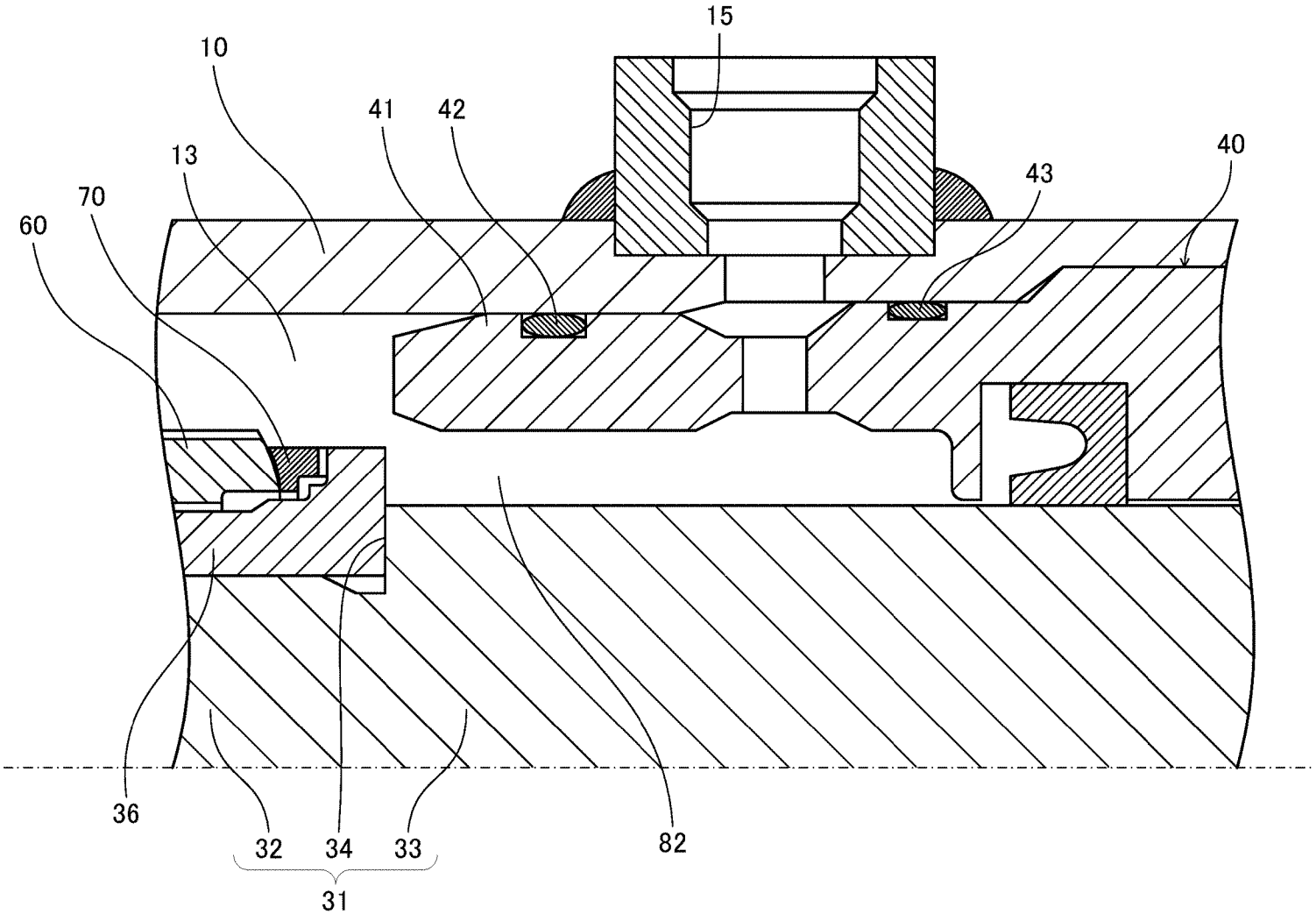
FIG. 3 is an enlarged sectional view around a head-side port and illustrates a state where the piston rod is in the normal stroke area.
Figure 4:
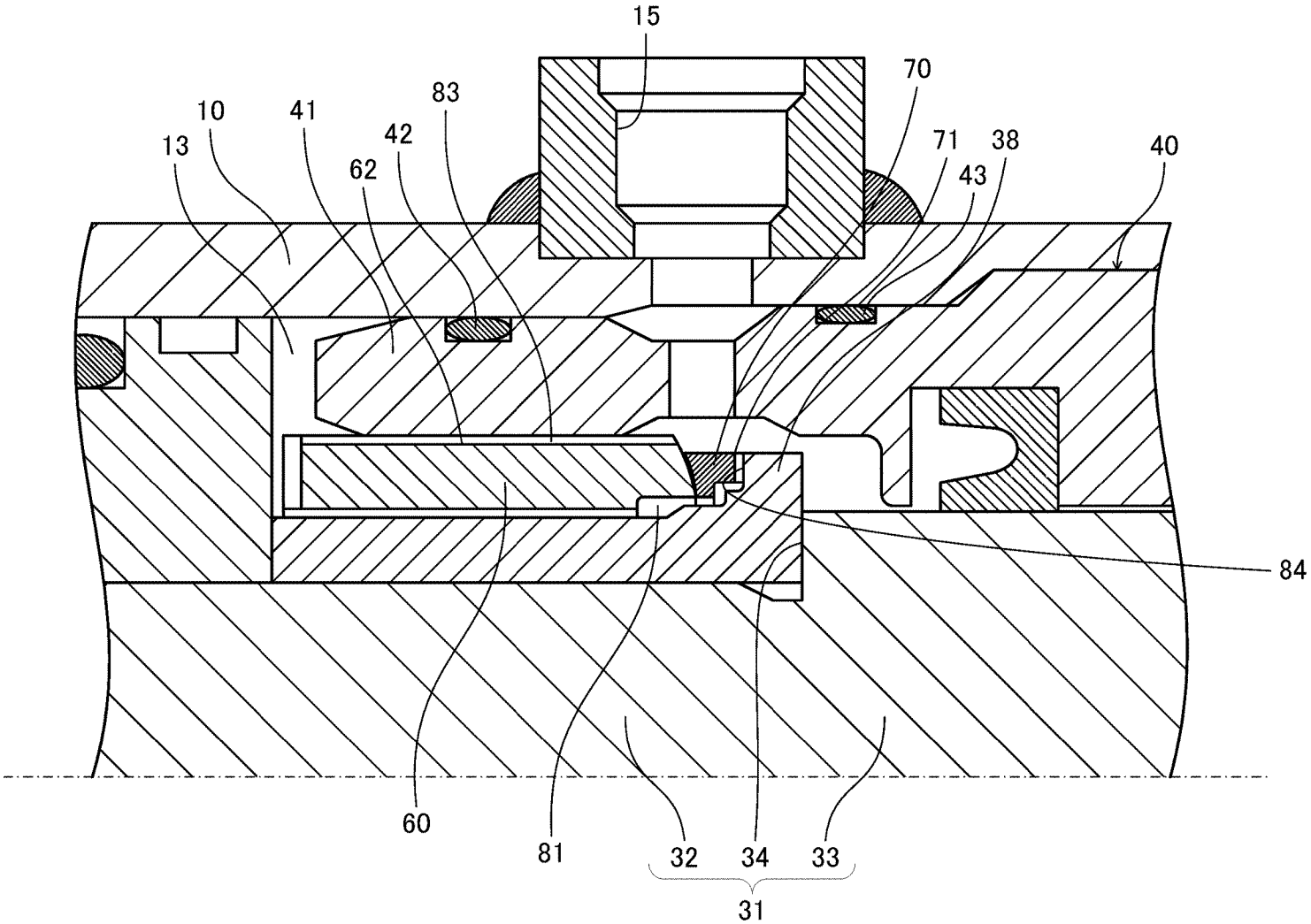
FIG. 4 is an enlarged sectional view around the head-side port and illustrates a state where the piston rod is in the vicinity of a stroke end.

Subsequently, a structure of the cylindrical portion 41 will be described. FIG. 3 is an enlarged sectional view around the head-side port 15 and illustrates a state where the piston rod 30 is in a normal stroke area (a state where the cushion bearing 60 has not entered the cylindrical portion 41). FIG. 4 is an enlarged sectional view around the head-side port 15 and illustrates a state where the piston rod 30 has reached the vicinity of the stroke end (a state where the cushion bearing 60 has entered the cylindrical portion 41).

As illustrated in FIG. 3, an outer diameter of the cylindrical portion 41 is substantially equal to an inner diameter of the cylinder tube 10, and the cylindrical portion 41 is fitted with the cylinder tube 10. Between the cylindrical portion 41 and the cylinder tube 10, seal members 42 and 43 are arranged. By means of the seal members 42 and 43, leakage of the operating oil from a gap between an outer peripheral surface of the cylindrical portion 41 and an inner peripheral surface of the cylinder tube 10 can be prevented.

An inner diameter of the cylindrical portion 41 is larger than the outer diameter of the large-diameter portion 33 in the rod body 31. Therefore, in the state where the piston rod 30 is in the normal stroke area, an annular passage 82 is formed by an inner peripheral surface of the cylindrical portion 41 and an outer peripheral surface of the large-diameter portion 33, and the rod side chamber 13 and the port 15 communicate with each other through the annular passage 82. That is, when the piston rod 30 is in the normal stroke area and the hydraulic cylinder 100 performs the expanding operation, the operating oil in the rod side chamber 13 is discharged from the port 15 through the annular passage 82.

As illustrated in FIG. 4, an outer diameter of the cushion bearing 60 is substantially equal to the inner diameter of the cylindrical portion 41. Therefore, in the state where the cushion bearing 60 has entered the cylindrical portion 41, the rod side chamber 13 and the port 15 communicate with each other only through an outer peripheral passage 83 formed by the groove 62 in the cushion bearing 60 and the inner peripheral surface of the cylindrical portion 41 and an inner peripheral passage 81.

In the expanding operation, the operating oil in the rod side chamber 13 moves to the port 15 only through the inner peripheral passage 81 and the outer peripheral passage 83. Channel sections of the inner peripheral passage 81 and the outer peripheral passage 83 are smaller than the annular passage 82 (see FIG. 3) and thus, resistance is applied to the flow of the operating oil discharged from the rod side chamber 13 through the port 15. As a result, a pressure in the rod side chamber 13 rises, and the piston rod 30 is decelerated.

Since the cushion bearing 60 and the collar 70 are movable in the axial direction even in the state having entered the cylindrical portion 41, it moves between the piston 20 and the flange portion 38 in accordance with the operation of the hydraulic cylinder 100 or specifically, the pressure in the rod side chamber 13.

Specifically, in the expanding operation of the hydraulic cylinder 100, by means of a pressure difference between the rod side chamber 13 and the port 15, the cushion bearing 60 and the collar 70 move to a direction getting closer to the flange portion 38. As a result, the cushion bearing 60 is brought into contact with the collar 70, and the collar 70 is brought into contact with the flange portion 38.

In the state where the collar 70 is in contact with the flange portion 38, a communication path 84 allowing the inner peripheral passage 81 to communicate with the port 15 is formed by the groove 71 in the collar 70 and the flange portion 38. A channel section of the communication path 84 is smaller than the channel section of the inner peripheral passage 81. Thus, resistance is applied mainly in the communication path 84 to the flow of the operating oil moving from the rod side chamber 13 to the port 15 through the inner peripheral passage 81 and the communication path 84.

In this embodiment, in the state where the cushion bearing 60 has entered the cylindrical portion 41, the rod side chamber 13 and the port 15 communicate through the outer peripheral passage 83 and communicate through the inner peripheral passage 81 and the communication path 84, this form is not limiting. For example, it may be so constituted that the groove 62 is not provided on the outer peripheral surface of the cushion bearing 60, and the rod side chamber 13 and the port 15 communicate only through the inner peripheral passage 81 and the communication path 84. Alternatively, it may be so constituted that the groove 71 is not provided on the collar 70, and the rod side chamber 13 and the port 15 communicate only through the outer peripheral passage 83.

Moreover, the groove 62 of the cushion bearing 60 does not have to be extended across the both ends of the cushion bearing 60, and in the state where the cushion bearing 60 has entered the cylindrical portion 41, it only needs to have a length allowing the rod side chamber 13 and the port 15 to communicate with each other.

The outer peripheral passage 83 is not limited to a form in which it is formed by the groove 62 and the inner peripheral surface of the cylindrical portion 41. For example, it may be so constituted that the outer peripheral surface of the cushion bearing 60 is formed having a plane shape without the groove 62, and the outer peripheral passage 83 is formed annularly between the outer peripheral surface of the cushion bearing 60 and the inner peripheral surface of the cylindrical portion 41.

Figure 5:
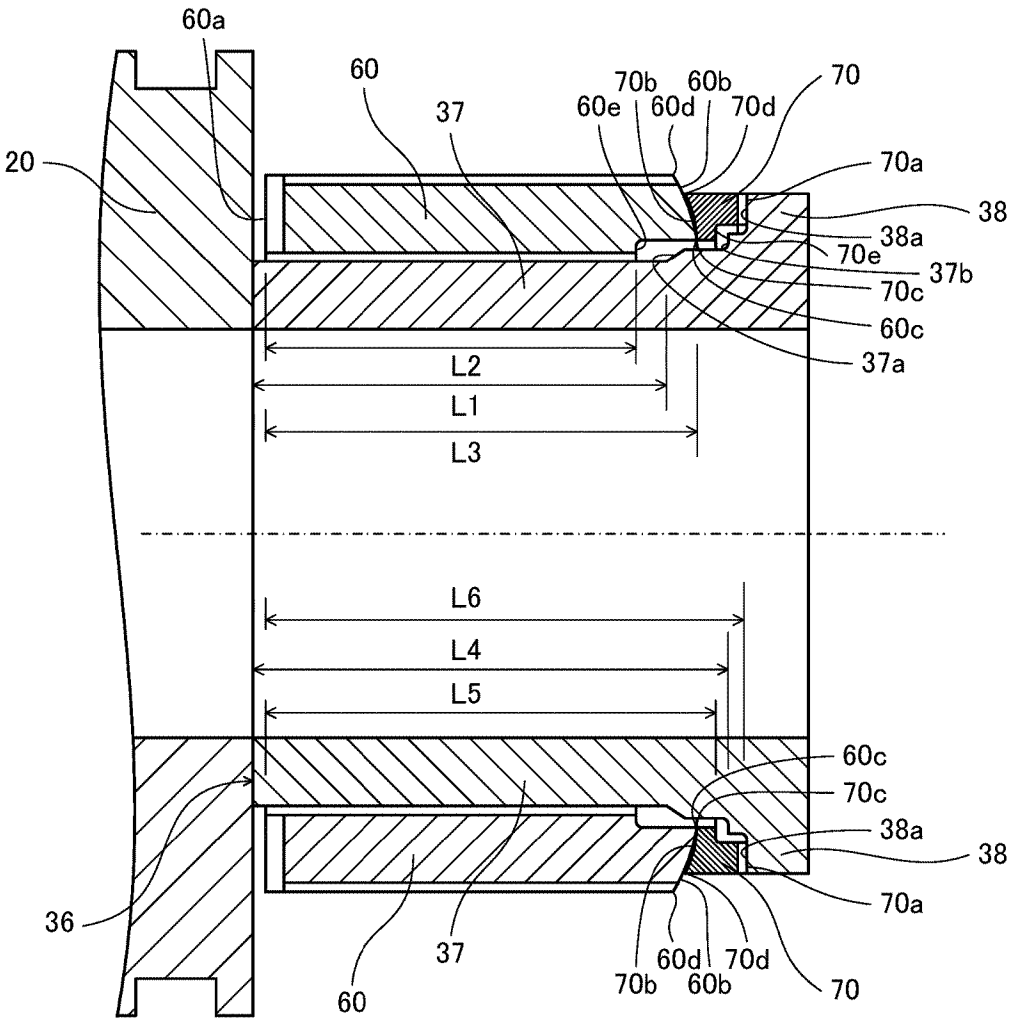
FIG. 5 is a sectional view of the cushion bearing, a collar, and a spacer and illustrates a state where center axes of the cushion bearing, the collar, and the spacer match each other.

FIG. 5 is a sectional view of the cushion bearing 60, the collar 70, and the spacer 36 and illustrates a state where the center axes of the cushion bearing 60, the collar 70, and the spacer 36 match each other. FIG. 5 illustrates a part of the piston 20. As illustrated in FIG. 5, end surfaces 60*b* and 70*b* faced with each other of the cushion bearing 60 and the collar 70 are inclined symmetrically to the center axis of the spacer 36.

Specifically, the end surface 60*b* of the cushion bearing 60 is inclined so that an edge 60*c* on an inner side in the radial direction is located closer to the flange portion 38 side than an edge 60*d* on an outer side in the radial direction. The end surface 70*b* of the collar 70 is inclined so that an edge 70*c* on the inner side in the radial direction is located closer to the flange portion 38 side than an edge 70*d* on the outer side in the radial direction similarly to the end surface 60*b* of the cushion bearing 60.

The phrase "to be inclined symmetrically to the center axis of the spacer 36" is not limited to a form in which portions of the end surfaces 60*b* and 70*b* at positions opposite to the center axis of the spacer 36 are inclined at the same angle but includes a form in which they are inclined at different angles.

Moreover, end surfaces 70*a* and 38*a* of the collar 70 and the flange portion 38 faced with each other are formed having plane shapes crossing the center axes of the collar 70 and the flange portion 38, respectively. Specifically, the end surfaces 70*b* and 38*a* are formed substantially perpendicularly to the center axis.

Figure 6:
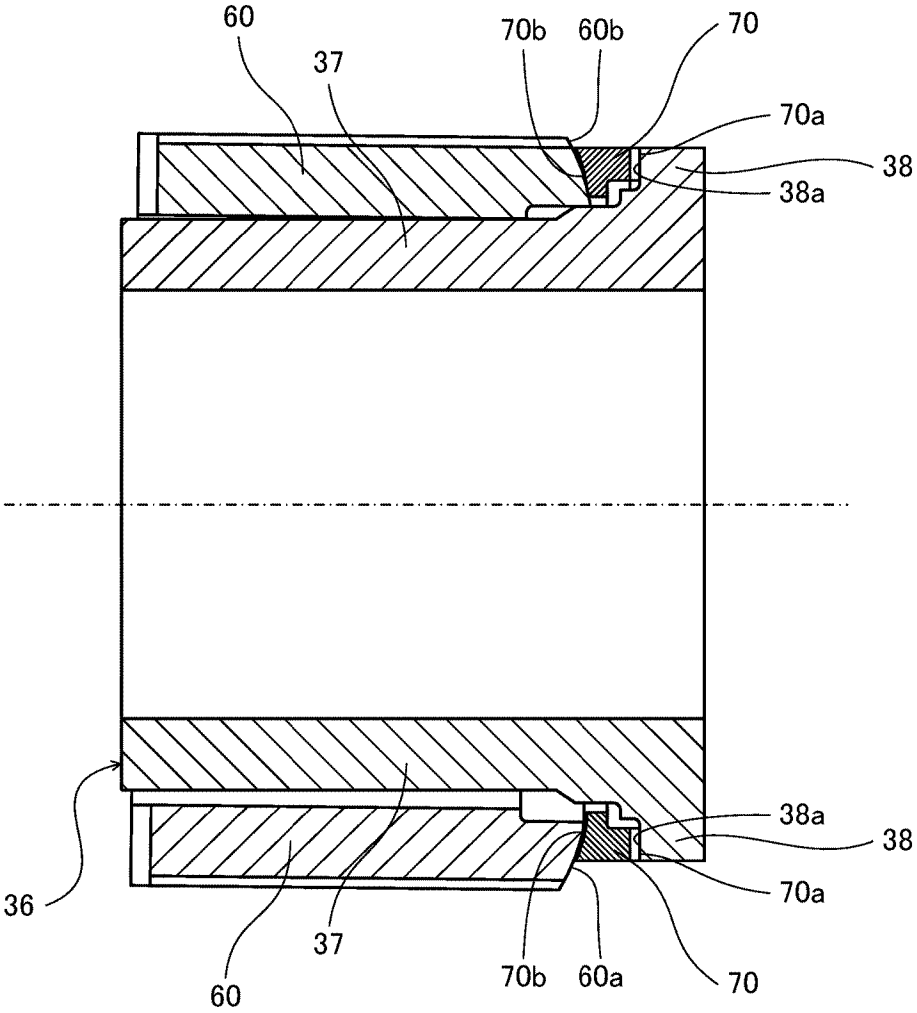
FIG. 6 is a sectional view of the cushion bearing, the collar, and the spacer and illustrates a state where the cushion bearing is inclined to the spacer.

FIG. 6 is a sectional view of the cushion bearing 60, the collar 70, and the spacer 36 and illustrates a state where the cushion bearing 60 is inclined to the spacer 36. Such inclination of the cushion bearing 60 is generated by inclination of the cylinder portion 41 to the piston rod 30, for example. The inclination of the cylindrical portion 41 depends on machining accuracy or mounting accuracy of the piston 20, the piston rod 30 and the cylinder head 40 and the like.

If the end surfaces 60*b* and 70*b* are formed substantially perpendicularly to the center axis of the spacer 36, when the cushion bearing 60 is inclined to the spacer 36, a partial gap is formed between the end surface 60*b* and the end surface 70*b*. The operating oil in the rod side chamber 13 (see FIG. 4 and the like) leaks out from this gap, and there is a concern that the cushioning performances lower.

In this embodiment, the end surfaces 60*b* and 70*b* are inclined symmetrically to the center axis of the spacer 36. Thus, as illustrated in FIG. 6, even if the cushion bearing 60 is inclined to the spacer 36, since the end surface 60*b* is brought into sliding contact along the end surface 70*b*, a gap is not formed easily between the end surface 60*b* and the end surface 70*b*. Therefore, an unintended passage is not formed easily between the end surface 60*b* and the end surface 70*b*, and lowering of the cushioning performances can be prevented.

Figure 7:
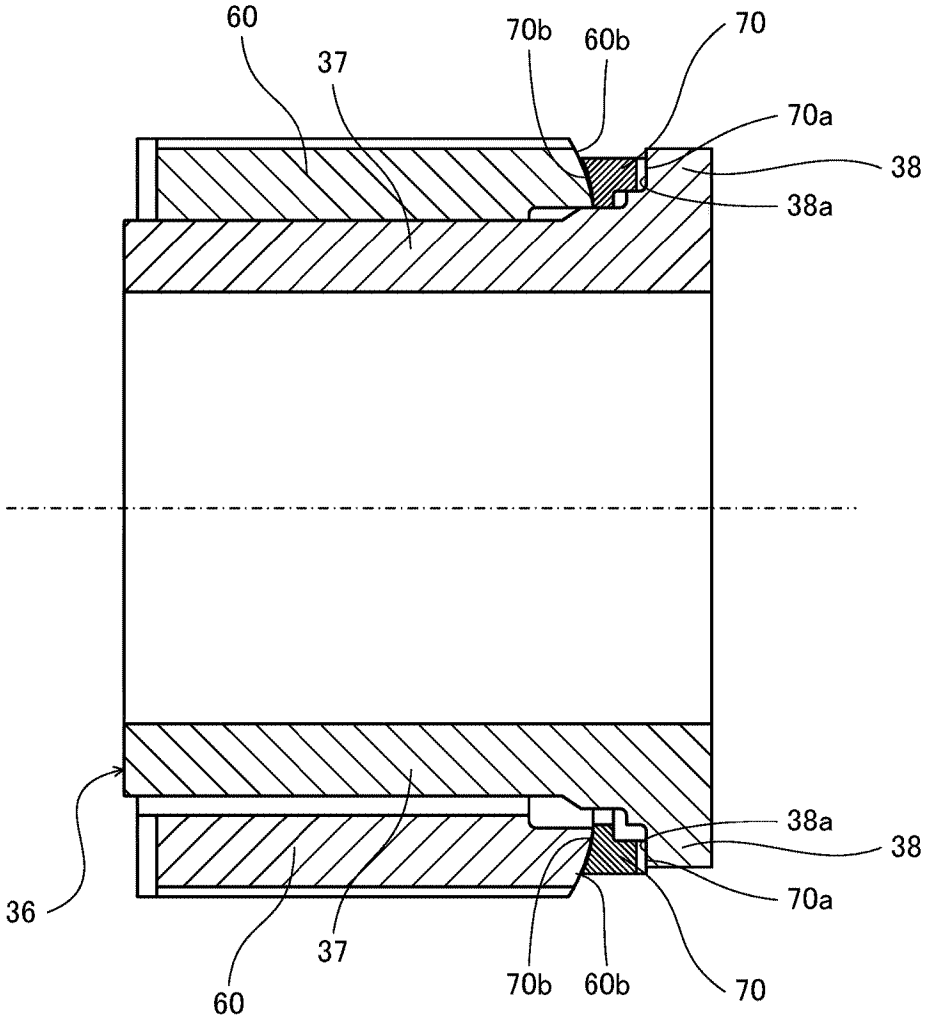
FIG. 7 is a sectional view of the cushion bearing, the collar, and the spacer and illustrates a state where the cushion bearing is deviated in a radial direction with respect to the spacer.

FIG. 7 is a sectional view of the cushion bearing 60, the collar 70, and the spacer 36 and illustrates a state where the cushion bearing 60 is shifted in the radial direction with respect to the spacer 36. Such a shift of the cushion bearing 60 is generated by, for example, a shift of the cylindrical portion 41 in the radial direction with respect to the piston rod 30 similarly to the inclination of the cushion bearing 60.

Since the collar 70 is provided movably in the radial direction, as illustrated in FIG. 7, the collar 70 is also moved with the shift of the cushion bearing 60. Therefore, even if the end surfaces 60*b* and 70*b* are inclined symmetrically to the center axis of the spacer 36, a gap is not formed easily between the end surface 60*b* and the end surface 70*b*.

Moreover, since the end surfaces 70*a* and 38*a* of the collar 70 and the flange portion 38 faced with each other are formed substantially perpendicularly to the center axis of the spacer 36, even if the collar 70 is moved in the radial direction with respect to the flange portion 38, a gap is not formed easily between the end surface 70*a* and the end surface 38*a*. Therefore, an unintended passage is not formed easily between the end surface 60*b* and the end surface 70*b* and between the end surface 70*a* and the end surface 38*a*, and lowering of the cushioning performances can be prevented.

As described above, in this embodiment, even if inclination and a shift are generated in the cushion bearing 60, an unintended passage is not formed easily, and communication between the rod side chamber 13 and the port 15 by the unintended passage can be prevented. Therefore, lowering of the cushioning performances can be prevented.

Figure 8:
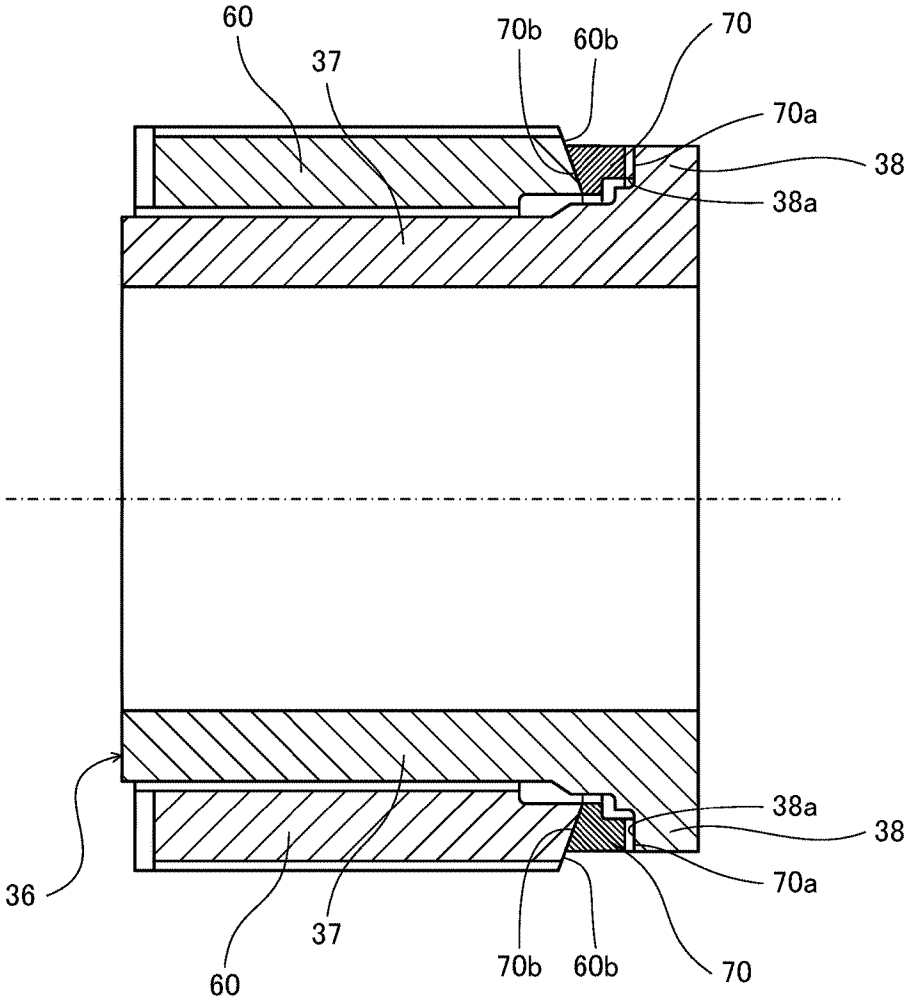
FIG. 8 is sectional view of the cushion bearing, the collar, and the spacer and illustrates another example of the cushion bearing and the collar.

As illustrated in FIG. 8, the end surfaces 60*b* and 70*b* may be planes. The end surfaces 60*b* and 70*b* preferably have curved surfaces and more preferably are parts of virtual spherical surfaces. By forming the end surfaces 60*b* and 70*b* so as to be parts of virtual spherical surfaces, even if the cushion bearing 60 is inclined, formation of a gap between the end surface 60*b* and the end surface 70*b* becomes more difficult, and lowering of the cushioning performances can be prevented more reliably.

In this embodiment, the end surfaces 70*a* and 38*a* are formed substantially perpendicularly to the center axis of the spacer 36, but it is only necessary that the end surfaces 70*a* and 38*a* cross the center axis of the spacer 36 and may be also inclined to the center axis of the spacer 36.

Figure 9:
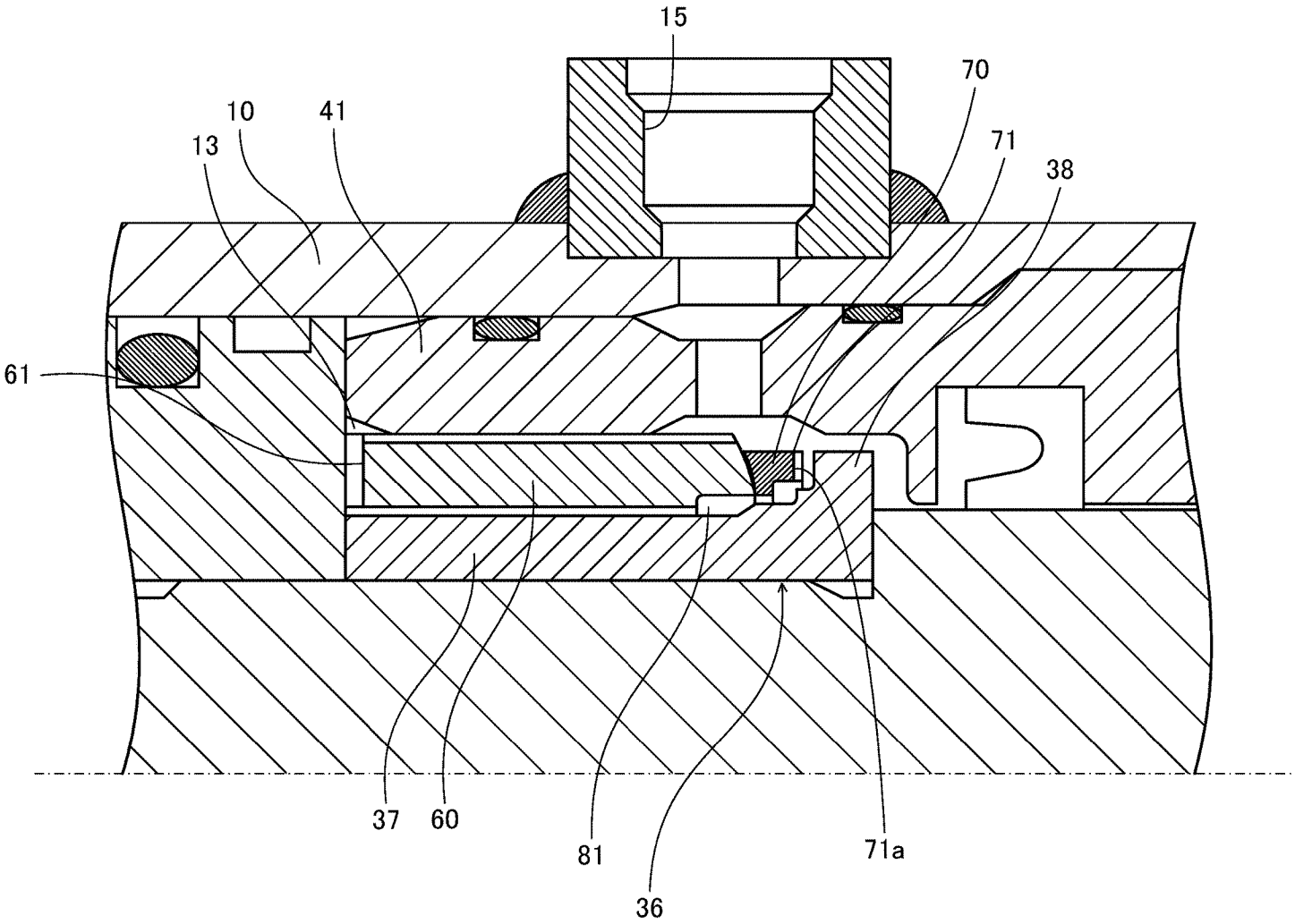
FIG. 9 is an enlarged sectional view around the head-side port and illustrates a state immediately after the hydraulic cylinder starts a contracting operation.

FIG. 9 is an enlarged sectional view around the port 15 and illustrates a state immediately after the hydraulic cylinder 100 starts the contracting operation. Immediately before the hydraulic cylinder 100 starts the contracting operation, as illustrated in FIG. 4, the cushion bearing 60 is brought into contact with the collar 70, and the collar 70 is brought into contact with the flange portion 38.

When the operating oil is supplied from a pump, not shown, to the port 15, the operating oil flows into the groove 71 of the collar 70. A pressure of the operating oil in the groove 71 acts on a bottom surface (pressure-receiving surface) 71*a* of the groove 71 and presses the collar 70 and the cushion bearing 60. That is, the bottom surface 71*a* of the groove 71 receives a pressure of the operating oil supplied from the port 15 in a direction separating from the flange portion 38 in a state where the collar 70 is in contact with the flange portion 38.

Upon receipt of the pressure of the operating oil by the bottom surface 71*a* of the groove 71, the collar 70 and the cushion bearing 60 are moved and thus, the collar 70 can be prevented from being stuck to the flange portion 38. By means of the movement of the collar 70 and the cushion bearing 60, as illustrated in FIG. 9, a gap is formed between the collar 70 and the flange portion 38. The operating oil from the port 15 flows into the inner peripheral passage 81 through this gap.

In a state where the cushion bearing 60 is in contact with the piston 20, the inner peripheral passage 81 and the rod side chamber 13 communicate with each other through the groove 61 of the cushion bearing 60. Therefore, the operating oil in the inner peripheral passage 81 can be supplied to the rod side chamber 13.

As described above, in this embodiment, immediately after the hydraulic cylinder 100 starts the contracting operation, the rod side chamber 13 and the port 15 communicate with each other through the inner peripheral passage 81. Thus, even in a state where the cushion bearing 60 has not come out of the cylindrical portion 41, the operating oil can be supplied to the rod side chamber 13 easily. Therefore, responsiveness of the hydraulic cylinder 100 can be improved.

Refer to FIG. 5 again. On the outer peripheral surface of the spacer body 37, a first spacer stepped portion (first rod stepped portion) 37*a* faced with the piston 20 with a part of the cushion bearing 60 between them is formed. The first spacer stepped portion 37*a* is formed by making the outer diameter of the spacer body 37 different at the first spacer stepped portion 37*a* as a boundary.

On the inner peripheral surface of the cushion bearing 60, a bearing stepped portion 60*e* faced with the first spacer stepped portion 37*a* is formed. The bearing stepped portion

60*e* is formed by making the inner diameter of the cushion bearing 60 different at the bearing stepped portion 60*e* as a boundary.

Moreover, on the outer peripheral surface of the spacer body 37, a second spacer stepped portion (second rod stepped portion) 37*b* faced with the piston 20 with a part of the cushion bearing 60 and the collar 70 between them is formed. The second spacer stepped portion 37*b* is formed by making the outer diameter of the spacer body 37 different at the second spacer stepped portion 37*b* as a boundary.

On the inner peripheral surface of the collar 70, a collar stepped portion 70*e* faced with the second spacer stepped portion 37*b* is formed. The collar stepped portion 70*e* is formed by making the inner diameter of the collar 70 different at the collar stepped portion 70*e* as a boundary.

A dimension L1 from the first spacer stepped portion 37*a* to the piston 20 is larger than a dimension L2 from the bearing stepped portion 60*e* to the end surface 60*a*. Therefore, in a state where the cushion bearing 60 is assembled to the spacer 36 in a correct direction, cushion bearing 60 does not protrude from the spacer 36.

Figure 10:
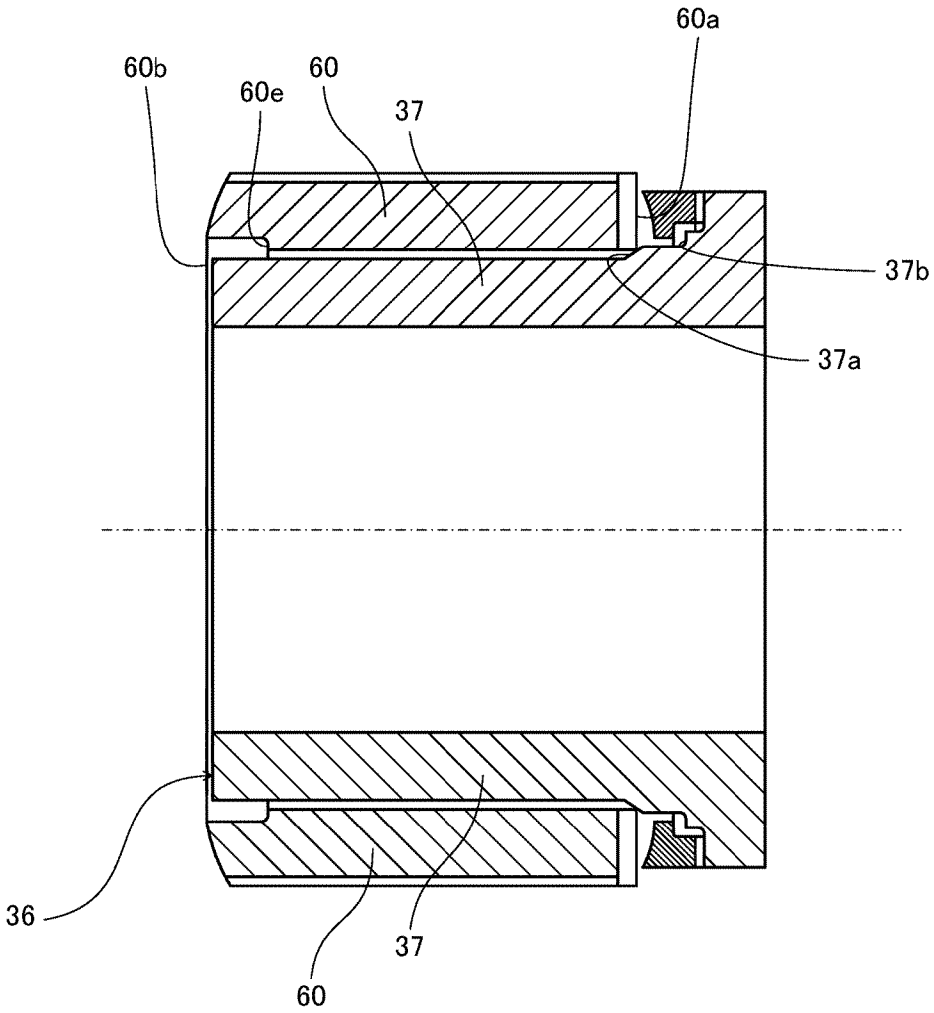
FIG. 10 is a sectional view of the cushion bearing, the collar, and the spacer and illustrates a state where the cushion bearing is assembled to the spacer in an opposite direction.

The dimension L1 is smaller than a dimension L3 of the cushion bearing 60 in the axial direction. Therefore, as illustrated in FIG. 10, if the cushion bearing 60 is assembled to the spacer 36 in an opposite direction, the cushion bearing 60 protrudes from the spacer 36. Therefore, whether the cushion bearing 60 has been assembled to the spacer 36 in a proper direction can be easily determined.

A dimension L4 from the second spacer stepped portion 37*b* to the piston 20 is larger than a dimension L5 from the collar stepped portion 70*e* to the end surface 60*a* in a state where the cushion bearing 60 is joined with the collar 70. Therefore, in the state where the cushion bearing 60 and the collar 70 are assembled to the spacer 36 in the correct direction, the cushion bearing 60 does not protrude from the spacer 36.

Figure 11:
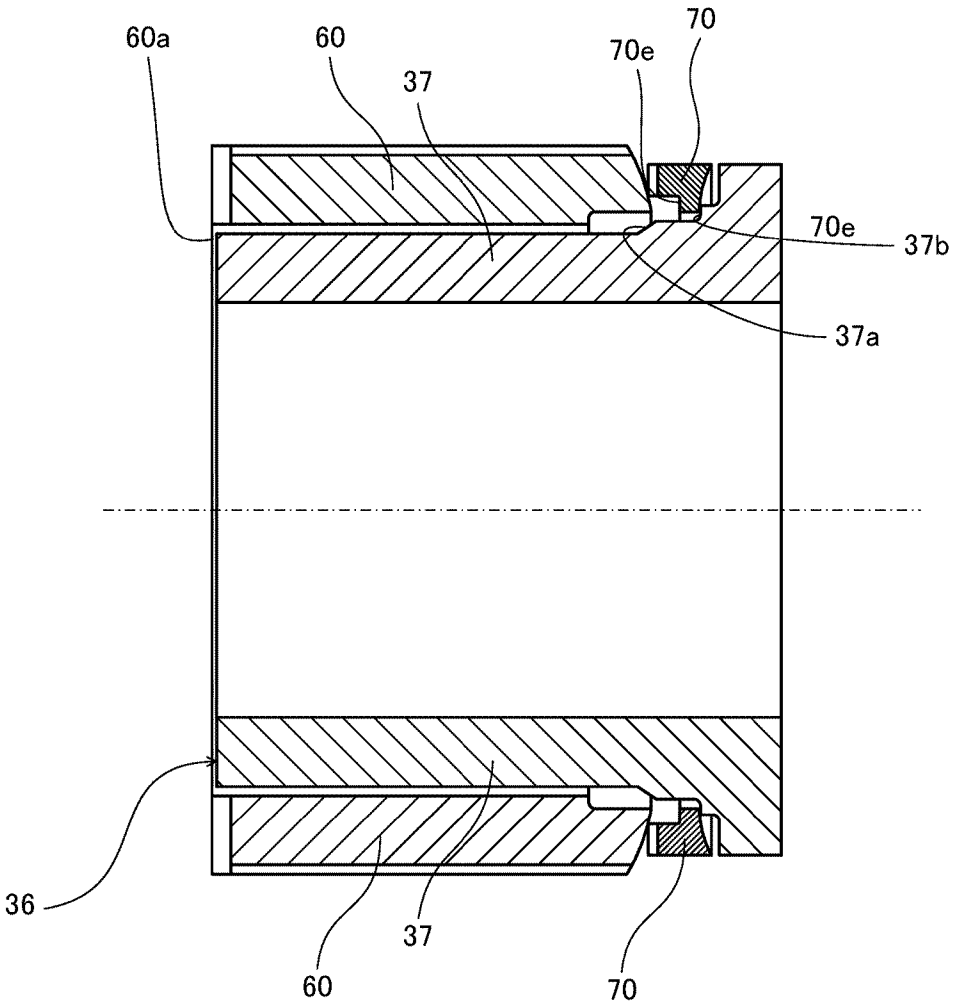
FIG. 11 is a sectional view of the cushion bearing, the collar, and the spacer and illustrates a state where the collar is assembled to the spacer in an opposite direction.

The dimension L4 is smaller than a dimension L6 combining the cushion bearing 60 and the collar 70 in the axial direction. Therefore, as illustrated in FIG. 11, when the collar 70 is assembled to the spacer 36 in the opposite direction, the cushion bearing 60 protrudes from the spacer 36. Therefore, whether the cushion bearing 60 has been assembled to the spacer 36 in the proper direction can be easily determined.

As described above, in this embodiment, whether the cushion bearing 60 and the collar 70 have been assembled to the spacer 36 in the proper direction can be easily determined, and assembling of the hydraulic cylinder 100 is facilitated.

Figure 12:
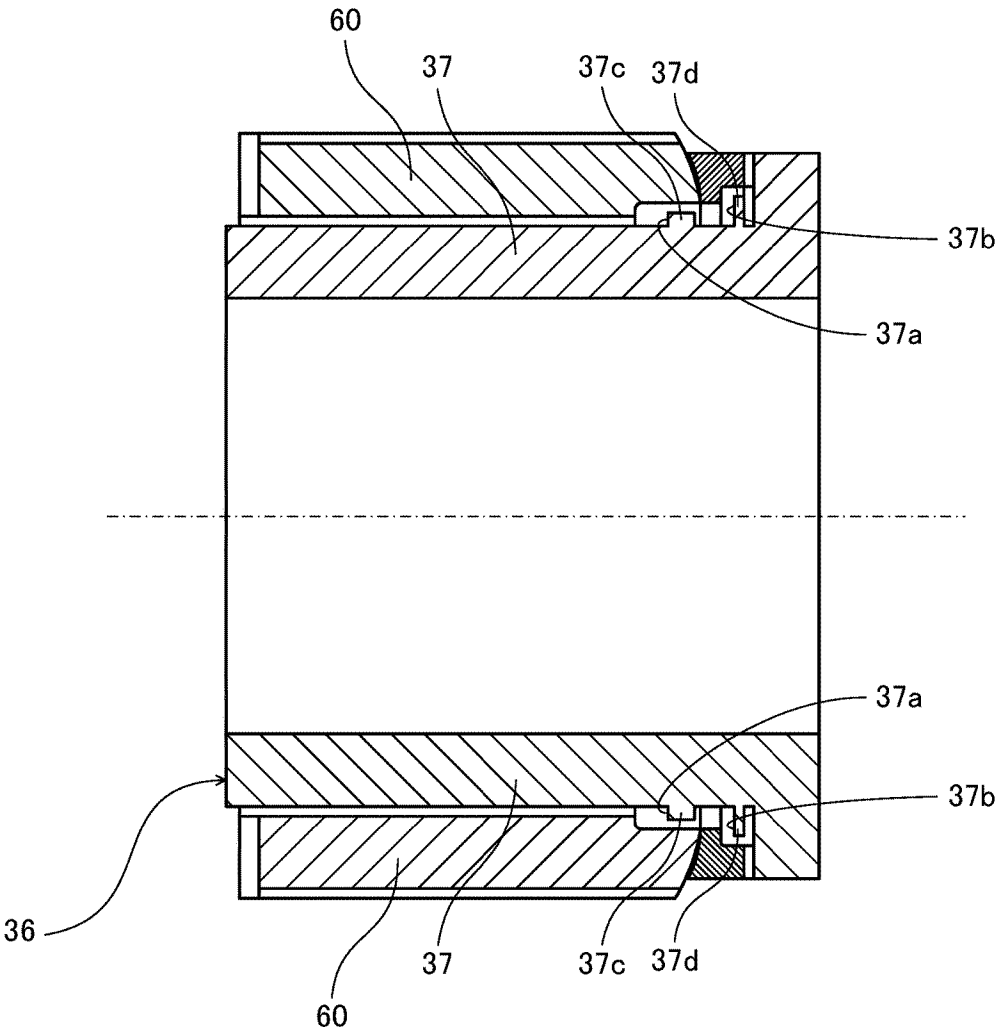
FIG. 12 is a sectional view of the cushion bearing, the collar, and the spacer and illustrates another example of first and second spacer stepped portions.

In this embodiment, the first spacer stepped portion 37*a* is formed by making the outer diameter of the spacer body 37 different at the first spacer stepped portion 37*a* as a boundary, but this form is not limiting. FIG. 12 is a sectional view illustrating another example of the first and second spacer stepped portions 37*a* and 37*b*. As illustrated in FIG. 12, the first spacer stepped portion 37*a* may be formed by providing a rib 37c protruding from the spacer body 37 to the outer side in the radial direction on the spacer 36. Similarly, the second spacer stepped portion 37*b* may be formed by a rib 37*d* protruding from the spacer body 37 to the inner side in the radial direction.

Moreover, in this embodiment, the bearing stepped portion 60*e* is formed by making the inner diameter of the cushion bearing 60 different at the bearing stepped portion 60*e* as a boundary, but this form is not limiting. For example, the bearing stepped portion 60*e* may be formed by providing the rib protruding from the cushion bearing 60 to the inner side in the radial direction on the cushion bearing 60. Similarly, the collar stepped portion 70*e* may be formed by the rib protruding from the collar 70 to the inner side in the radial direction.

Subsequently, the operation of the hydraulic cylinder 100 will be described by referring to FIGS. 1 to 7 and FIGS. 9 to 11.

First, the expanding operation of the hydraulic cylinder 100 will be described.

When the operating oil is supplied from the port 16, the piston 20 and the piston rod 30 are moved in the direction for contracting the rod side chamber 13, and the operating oil in the rod side chamber 13 is discharged through the annular passage 82 and the port 15.

When the piston 20 and the piston rod 30 are further moved, the cushion bearing 60 enters the cylindrical portion 41. At this time, the flow of the operating oil moving from the rod side chamber 13 to the port 15 is narrowed down by the cushion bearing 60. As a result, resistance is applied to this flow, the pressure in the rod side chamber 13 rises, and the piston rod 30 is decelerated.

Since the end surface 60*b* of the cushion bearing 60 and the end surface 70*b* of the collar 70 are formed with inclination symmetrically to the center axis of the spacer 36, even if the cushion bearing 60 is inclined, an unintended gap is not formed easily between the end surface 60*b* and the end surface 70*b*.

Moreover, since the collar 70 is movable in the radial direction, even if the cushion bearing 60 is shifted, an unintended gap is not formed easily between the end surface 60*b* of the cushion bearing 60 and the end surface 70*b* of the collar 70.

Furthermore, since the end surfaces 70*a* and 38*a* of the collar 70 and the flange portion 38 are formed having plane shapes crossing the center of the spacer 36, even if the collar 70 is moved in the radial direction, an unintended gap is not formed easily between the end surface 70*a* of the collar 70 and the end surface 38*a* of the flange portion 38.

Therefore, lowering of the cushioning performances can be prevented.

Subsequently, the contracting operation of the hydraulic cylinder 100 will be described.

When the operating oil is supplied from the port 15, the operating oil is supplied to the groove 71 of the collar 70, and the collar 70 is pressed. The collar 70 and the cushion bearing 60 are moved, and a gap is formed between the collar 70 and the flange portion 38. The operating oil from the port 15 is supplied to the rod side chamber 13 through this gap and the inner peripheral passage 81.

By means of the supply of the operating oil to the rod side chamber 13, the piston 20 and the piston rod 30 are moved in the direction for reducing the anti-rod side chamber 14, and the hydraulic cylinder 100 is contracted. The operating oil in the anti-rod side chamber 14 is discharged through the port 16.

In this embodiment, even in the state where the cushion bearing 60 has entered into the cylindrical portion 41, the operating oil is supplied to the rod side chamber 13 and thus, responsiveness of the hydraulic cylinder 100 can be improved.

Subsequently, the constitution, action, and effects of the embodiment of the present invention will be described altogether.

In this embodiment, the cylinder tube 10, the piston 20 slidably accommodated in the cylinder tube 10 and defining the rod side chamber 13 in the cylinder tube 10, the piston rod 30 connected to the piston 20, the port 15 communicating with the rod side chamber 13 and supplying the operating oil from the outside to the rod side chamber 13 and discharging the operating oil in the rod side chamber 13 to the outside, the cushion bearing 60 provided movably on the outer periphery of the piston rod 30 and narrowing down the flow of the operating oil discharged from the rod side chamber 13 through the port 15 when the piston rod 30 reaches the stroke end, the flange portion 38 provided on the piston rod 30 by facing the piston 20 with the cushion bearing 60 between them and limiting movement of the cushion bearing 60 in the axial direction, and the collar 70 provided movably in the radial direction on the outer periphery of the piston rod 30 between the cushion bearing 60 and the flange portion 38, and the end surfaces 60*b* and 70*b* faced with each other of the cushion bearing 60 and the collar 70 are inclined symmetrically to the center axis of the piston rod 30, and the end surfaces 38*a* and 70*a* of the flange portion 38 and the collar 70 faced with each other are formed having plane shapes crossing the center axis.

In this constitution, since the end surfaces 60*b* and 70*b* of the cushion bearing 60 and the collar 70 faced with each other are inclined symmetrically to the center axis of the piston rod 30, even if the cushion bearing 60 is inclined to the piston rod 30, a gap is not formed easily between the end surface 60*b* and the end surface 70*b*. Moreover, since the collar 70 is movable in the radial direction, the collar 70 is also moved with the shift of the cushion bearing 60, and a gap is not formed easily between the end surfaces 60*b* and 70*b*. Furthermore, since the end surfaces 70*a* and 38*a* of the collar 70 and the flange portion 38 faced with each other are formed having plane shapes crossing the center axis, even if the collar 70 is moved in the radial direction, a gap is not formed easily between the end surface 70*a* and the end surface 38*a*. Therefore, lowering of the cushioning performances can be prevented.

Moreover, in this embodiment, the cushion bearing 60 and the spacer 36 have the bearing stepped portion 60*e* and the first spacer stepped portion 37*a* faced with each other, respectively, and the dimension L1 from the first spacer stepped portion 37*a* to the piston 20 is smaller than the dimension L3 of the cushion bearing 60 in the axial direction.

In this constitution, since the dimension L1 from the first spacer stepped portion 37*a* to the piston 20 is smaller than the dimension L3 of the cushion bearing 60 in the axial direction, if the cushion bearing 60 is assembled to the spacer 36 in the opposite direction, the cushion bearing 60 protrudes from the spacer 36. Therefore, whether the cushion bearing 60 has been assembled to the spacer 36 in the proper direction can be easily determined.

Moreover, in this embodiment, the collar 70 and the spacer 36 have the collar stepped portion 70*e* and the second spacer stepped portion 37*b* faced with each other, respectively, and the dimension L4 from the second spacer stepped portion 37*b* to the piston 20 is smaller than the dimension L6 combining the cushion bearing 60 and the collar 70 in the axial direction.

In this constitution, since the dimension L4 from the second spacer stepped portion 37*b* to the piston 20 is smaller than the dimension L6 combining the cushion bearing 60 and the collar 70 in the axial direction, if the collar 70 is assembled to the spacer 36 in the opposite direction, the cushion bearing 60 protrudes from the spacer 36. Therefore, whether the collar 70 has been assembled to the spacer 36 in the proper direction can be easily determined.

Moreover, in this embodiment, between the cushion bearing 60 and the piston rod 30, and between the collar 70 and the piston rod 30, the inner peripheral passage 81 is formed, and the rod side chamber 13 and the port 15 communicate with each other through the inner peripheral passage 81.

In this constitution, since the rod side chamber 13 and the port 15 communicate with each other through the inner peripheral passage 81, when the cushion bearing 60 narrows down the flow of the operating oil, the operating oil in the rod side chamber 13 is moved toward the port 15 through the inner peripheral passage 81. Therefore, a rise of the pressure in the inner peripheral passage 81 can be prevented, and a resistance applying function can be given to the inner peripheral passage 81.

Moreover, in this embodiment, between the collar 70 and the flange portion 38, the communication path 84 allowing the inner peripheral passage 81 and the port 15 to communicate with each other is formed.

In this constitution, since the inner peripheral passage 81 and the port 15 communicate with each other through the communication path 84, when the cushion bearing 60 narrows down the flow of the operating oil, the operating oil in the rod side chamber 13 is moved toward the port 15 through the inner peripheral passage 81 and the communication path 84. Therefore, the resistance applying function can be given to the communication path 84.

Moreover, in this embodiment, the collar 70 is capable of relative movement in the axial direction with respect to the piston rod 30 and has a pressure receiving surface receiving the pressure of the operating oil supplied from the port 15 in the direction separating from the flange portion 38 in the state in contact with the flange portion 38.

In this constitution, since the collar 70 has the pressure receiving surface receiving the pressure of the operating oil in the direction separating from the flange portion 38, the collar 70 is separated from the flange portion 38 by the pressure of the operating oil from the port 15 in the contracting operation of the hydraulic cylinder 100 and forms a gap between it and the flange portion 38. Therefore, the operating oil from the port 15 can be supplied to the rod side chamber 13 through the gap between the cushion bearing 60 and the piston rod 30, and responsiveness of the hydraulic cylinder 100 can be improved.

Moreover, in this embodiment, the cylindrical portion 41 provided on the cylinder tube 10 and formed capable of receiving the cushion bearing 60 is further provided, and in the state where the cushion bearing 60 has entered the cylindrical portion 41, the outer peripheral passage 83 allowing the rod side chamber 13 and the port 15 to communicate with each other is formed between the outer peripheral surface of the cushion bearing 60 and the inner peripheral surface of the cylindrical portion 41.

In this constitution, since the rod side chamber 13 and the port 15 communicate with each other by the outer peripheral passage 83 in the state where the cushion bearing 60 has entered the cylindrical portion 41, the operating oil in the rod side chamber 13 is moved toward the port 15 through the outer peripheral passage 83 when the cushion bearing 60 narrows down the flow of the operating oil. Therefore, the resistance applying function can be given to the outer peripheral passage 83.

Moreover, in this embodiment, the piston rod 30 has the rod body 31 having the rod stepped portion 34 faced with the piston 20 and the spacer 36 provided on the outer periphery of the rod body 31 and ensuring an interval between the piston 20 and the rod stepped portion 34, and the cushion bearing 60 and the collar 70 are provided on the outer periphery of the spacer 36, and the spacer 36 has the flange portion 38.

In this constitution, since the piston rod 30 has the spacer 36 for ensuring the interval between the piston 20 and the rod stepped portion 34 and the spacer 36 has the flange portion 38, the spacer 36 pressed by the piston 20 and the flange portion 38 pressed by the collar 70 do not have to be formed by the same material as that of the rod body 31. Therefore, the rod body 31 can be formed by an inexpensive material with low strength, and the spacer 36 including the flange portion 38 can be formed by an expensive material with high strength, and the strength of the piston rod 30 can be improved while a cost increase of the piston rod 30 is suppressed.

The embodiments of the present invention described above are merely illustration of some application examples of the present invention and not of the nature to limit the technical scope of the present invention to the specific constructions of the above embodiments.

For example, the spacer 36 does not have to have the flange portion 38 as a limiting portion, and the limiting portion may be provided on the rod body 31. Depending on the specification of the hydraulic cylinder 100 such that the outer diameter of the piston rod 30 is sufficiently large, the piston rod 30 does not have to have the spacer 36. The spacer 36 of the piston rod 30 and the rod body 31 may be integrally formed. By means of the integral molding of the spacer 36 and the rod body 31, the number of components of the hydraulic cylinder 100 can be reduced.

If the spacer 36 of the piston rod 30 and the rod body 31 are integrally formed, the first and second spacer stepped portions 37*a* and 37*b* of the spacer 36 are formed as the first and second rod stepped portions on the piston rod 30.

The outer peripheral passage 83 does not have to be formed between the cushion bearing 60 and the cylindrical portion 41. The rod side chamber 13 and the port 15 may communicate with each other through a through hole formed in the spacer 36 or a through hole formed in the cushion bearing 60.

The pressure receiving surface is not limited to the bottom surface 71*a* of the groove 71. By forming the end surface 70*a* of the collar 70 with a rough surface (roughness of the end surface 70*a* is increased), a gap is formed between the end surface 70*a* of the collar 70 and the end surface 38*a* of the flange portion 38, and the pressure of the operating oil flowing into this gap may be made to act on the end surface 70*a*. That is, the end surface 70*a* formed with the rough surface may be made a pressure receiving surface. By making the end surface 70*a* with the rough surface, too, sticking between the collar 70 and the flange portion 38 can be prevented.

The communication path 84 is not limited to the form formed by the groove 71 of the collar 70 and the flange portion 38. Instead of the groove 71 formed in the collar 70, a groove may be formed in the flange portion 38, and the communication path 84 may be formed by this groove and the end surface 70*a* of the collar 70. That is, the communication path 84 only needs to be formed between the collar 70 and the flange portion (limiting portion) 38.

The inner peripheral passage 81 and the port 15 may communicate with each other through a through hole formed in the collar 70 or a through hole formed in the flange portion 38 instead of the communication path 84 between the collar 70 and the flange portion 38. The inner peripheral passage 81 and the port 15 may communicate with each other through a groove formed in the end surface 60*b* of the cushion bearing 60. That is, the inner peripheral passage 81 and the port 15 may communicate with each other through another passage without providing the communication path 84 between the collar 70 and the flange portion 38. If the communication path 84 is not formed between the collar 70 and the flange portion 38, the collar end surface 70*a* may be formed having a plane shape.

The inner peripheral passage 81 is not limited to the annular form. A groove formed in the spacer 36, a groove formed in the cushion bearing 60 or a groove formed in the collar 70 may be used as the inner peripheral passage 81, for example. The rod side chamber 13 and the port 15 may communicate with each other through a through hole formed in the spacer 36, a through hole formed in the cushion bearing 60 or a through hole formed in the collar 70 instead of the inner peripheral passage 81.

Even if the inner peripheral passage 81 is not formed annularly and even if the inner peripheral passage 81 is not formed, depending on the machining accuracy and the mounting accuracy of the piston 20, the piston rod 30, the cylinder head 40 and the like, inclination or a shift might be caused in the cushion bearing 60. In the hydraulic cylinder 100, even if the inclination or shift is caused in the cushion bearing 60, an unintended passage is not formed easily. Therefore, communication between the rod side chamber 13 and the port 15 by the unintended passage can be prevented, and lowering of the cushioning performances can be prevented.

The present application claims a priority based on Japanese Patent Application No. 2015-195786 filed with the Japan Patent Office on Oct. 1, 2015, all the contents of which are hereby incorporated by reference.

The invention claimed is:

1. A fluid pressure cylinder comprising:

a cylinder tube;

a piston slidably accommodated in the cylinder tube, the piston defining a rod side chamber in the cylinder tube;

a piston rod connected to the piston;

a port communicating with the rod side chamber, the port being configured to supply an operating fluid from an outside to the rod side chamber and discharge the operating fluid in the rod side chamber to the outside;

a cushion bearing provided movably on an outer periphery of the piston rod, the cushion bearing being configured to narrow down the flow of the operating fluid discharged from the rod side chamber through the port when the piston rod reaches a stroke end;

a limiting portion provided on the piston rod by facing the piston with the cushion bearing between them, the limiting portion being configured to limit movement of the cushion bearing in an axial direction; and a collar provided movably in a radial direction on the outer periphery of the piston rod between the cushion bearing and the limiting portion, wherein end surfaces of the cushion bearing and the collar faced with each other are inclined symmetrically to a center axis of the piston rod, and end surfaces of the limiting portion and the collar faced with each other are formed having plane shapes crossing the center axis.

2. The fluid pressure cylinder according to claim 1, wherein the cushion bearing and the piston rod have a bearing stepped portion and a first rod stepped portion faced with each other, respectively; and a dimension from the first rod stepped portion to the piston is smaller than a dimension of the cushion bearing in an axial direction.

3. The fluid pressure cylinder according to claim 1, wherein the collar and the piston rod have a collar stepped portion and a second rod stepped portion faced with each other, respectively; and a dimension from the second rod stepped portion to the piston is smaller than a dimension combining the cushion bearing and the collar in the axial direction.

4. The fluid pressure cylinder according to claim 1, wherein an inner peripheral passage is formed between the cushion bearing and the piston rod and between the collar and the piston rod, and the rod side chamber and the port communicate with each other through the inner peripheral passage.

5. The fluid pressure cylinder according to claim 4, wherein a communication path allowing the inner peripheral passage and the port to communicate with each other is formed between the collar and the limiting portion.

6. The fluid pressure cylinder according to claim 1, wherein the collar is capable of relative movement in the axial direction with respect to the piston rod and has a pressure receiving surface receiving a pressure of the operating fluid supplied from the port in a direction separating from the limiting portion in a state in contact with the limiting portion.

7. The fluid pressure cylinder according to claim 1, further comprising:

a cylindrical portion provided on the cylinder tube, the cylindrical portion being formed capable of receiving the cushion bearing; and in a state where the cushion bearing has entered the cylindrical portion, an outer peripheral passage allowing the rod side chamber and the port to communicate with each other is formed between an outer peripheral surface of the cushion bearing and an inner peripheral surface of the cylindrical portion.

8. The fluid pressure cylinder according to claim 1, wherein the piston rod has a rod body having a rod stepped portion faced with the piston; and a spacer provided on the outer periphery of the rod body, the spacer ensuring an interval between the piston and the rod stepped portion, the cushion bearing and the collar are provided on the outer periphery of the spacer, and the spacer has the limiting portion.

* * * * *